US006708845B2

(12) United States Patent
Weng

(10) Patent No.: US 6,708,845 B2
(45) Date of Patent: Mar. 23, 2004

(54) HYGIENE DEVICE

(76) Inventor: August M H Weng, 702 S. Stoneman Ave., #D, Alhambra, CA (US) 91801

( * ) Notice: Subject to any disclaimer, the term of this patent is extended or adjusted under 35 U.S.C. 154(b) by 279 days.

(21) Appl. No.: 10/017,150

(22) Filed: Dec. 14, 2001

(65) Prior Publication Data

US 2003/0052136 A1 Mar. 20, 2003

(51) Int. Cl.[7] ..... B67D 5/08

(52) U.S. Cl. ..... 222/61; 222/135; 222/179; 222/192; 222/321.8

(58) Field of Search ..... 222/61, 129, 132, 222/135, 179, 192, 321.8; 221/96

(56) References Cited

U.S. PATENT DOCUMENTS 3,233,787 A * 2/1966 Ross ..... 222/179
3,865,271 A * 2/1975 Gold ..... 221/96
5,299,713 A * 4/1994 Saitoh ..... 222/51

* cited by examiner

*Primary Examiner*—Philippe Derakshani
(74) *Attorney, Agent, or Firm*—Raymond Y. Chan; David and Raymond Patent Group

(57) ABSTRACT

A hygiene device includes two cleansing arrangements for carrying two different kinds of cleansing solutions. Each of the cleansing arrangements includes a container body having a liquid reservoir for receiving the corresponding cleansing solution therein and an opening for communicating the liquid reservoir with outside, a pumping unit, having a dispensing nozzle, detachably attached to the container body to sealedly cover the opening and arranged to pump the cleansing solution from the liquid reservoir towards the dispensing nozzle, and a first hands-free actuating unit arranged to actuate the pumping unit for dispensing a predetermined amount of the corresponding cleansing solution on a wiping medium via the dispensing nozzle. Therefore, the user is able to dispense the cleansing solution from the cleansing arrangement to moisture the wiping medium without hand contacting operation, so as to prevent the cleansing solution from being polluted by the user's hand.

22 Claims, 5 Drawing Sheets

HYGIENE DEVICE

BACKGROUND OF THE PRESENT INVENTION

1. Field of Invention

The present invention relates to toilet paper, and more particularly to a toilet paper hygiene device which is adapted for dispensing a predetermined amount of cleansing solution on a toilet paper so as to moisture the toilet paper before it is used.

2. Description of Related Arts

After excretion, people are used to use toilet paper to wipe their buttocks for cleaning purpose. Usually the toilet paper is sold in roll, which is considerably large and bulky for daily carriage. Therefore, the roll of toilet paper is pre-set in the restroom close to the toilet bowl. In other words, the toilet paper is just stayed in the restroom and prepared for future usage. Therefore, the toilet paper stayed in the restroom is an inadequate cleaning utility because the sterility of the toilet paper is not guaranteed. Moreover, the residue remained on the buttock of the individual may not be totally cleaned up by only using the toilet paper.

Is the public restroom clean? Does any regularly check up and sterilization for the public restroom? These questions are most concerned by the user. Since the hygiene condition of the public restroom may not as good as the domestic one, the user prefers go to his or her restroom rather than to the public restroom unless there is an emergency.

In order to prevent any infection from the restroom, some people may purchase bottles of sterilizing agent and detergent and apply on the toilet paper for enhancing the cleansing ability of the toilet paper by not only removing the residue remained on the buttock but also cleaning the toilet paper before it is used. However, these bottles are unsuited for daily carrying around. Another problem with these bottles is that the user must use his or her hands to manipulate, which will pollute the cleaning solutions inside the bottles. Therefore, none of the public restrooms provide such sterilizing agent and/or detergent for public use because most public users may merely refuse to use the cleaning solutions in the public restroom since he or she does not know that these public bottles have been used by previous users.

SUMMARY OF THE PRESENT INVENTION

A main object of the present invention is to provide a hygiene device which is adapted for dispensing a predetermined amount of cleansing solution, such as a detergent, disinfectant, or skin lotion, on a toilet paper so as to clean and moisture the toilet paper before it is used.

Another object of the present invention is to provide a hygiene device for moistening the toilet paper, which enables a user to clean his or her body, especially after excretion, for domestic and commercial uses.

Another object of the present invention is to provide a hygiene device which has a compact size such that the hygiene device can be mounted on any wall without taking up much space. The present invention is preferred to be equipped with a toilet paper supporting frame in the restroom or in the kitchen so as to intentionally incorporate with the toilet paper before the toilet paper is used.

Another object of the present invention is to provide a hygiene device, wherein no specified toilet paper is required to incorporate with the hygiene device. In other words, the hygiene device of the present invention fits for any kind of toilet paper.

Another object of the present invention is to provide a hygiene device which is capable of not only enhancing the cleansing ability of the toilet paper to clean the residue remained on the buttock of the user but also sterilizing the toilet paper before it is used.

Another object of the present invention is to provide a hygiene device which is easy and safe to use. Due to hygiene purpose, the present invention requires hand-free operation to actuate the cleansing solution contained in the container, so as to prevent the cleansing solution having any contact with the user. Therefore, it is guarantee for the cleanness of the container and the safety of the use of the cleansing solution.

Another object of the present invention is to provide a hygiene device which is easy and economical to use so as to ensure a relatively low cost. According to the present invention, the cleansing solution can be a detergent, disinfectant, and/or skin lotion, which can be refilled in the container, so as to minimize the long-term cost of the present invention.

Accordingly, in order to accomplish the above objects, the present invention provides a hygiene device, comprising:

a first cleansing arrangement comprising a first container body having a first liquid reservoir for receiving a first cleansing solution therein, a first pumping unit, having a first dispensing nozzle, detachably attached to the first container body and arranged to pump the first cleansing solution from the first liquid reservoir towards the first dispensing nozzle, and a first hands-free actuating unit arranged to actuate the first pumping unit for dispensing a predetermined amount of the first cleansing solution on a first wiping medium via the first dispensing nozzle; and a second cleansing arrangement comprising a second container body having a second liquid reservoir for receiving a second cleansing solution therein, a second pumping unit, having a second dispensing nozzle, detachably attached to the second container body and arranged to pump the second cleansing solution from the second liquid reservoir towards the second dispensing nozzle, and a second hands-free actuating unit arranged to actuate the second pumping unit for dispensing a predetermined amount of the second cleansing solution on a second wiping medium via the second dispensing nozzle, wherein the first and second cleansing solutions have different cleaning abilities for selectively moistening the first and second wiping mediums respectively before the first and second wiping mediums are used.

DETAILED DESCRIPTION OF THE PREFERRED EMBODIMENT

Figure 1:
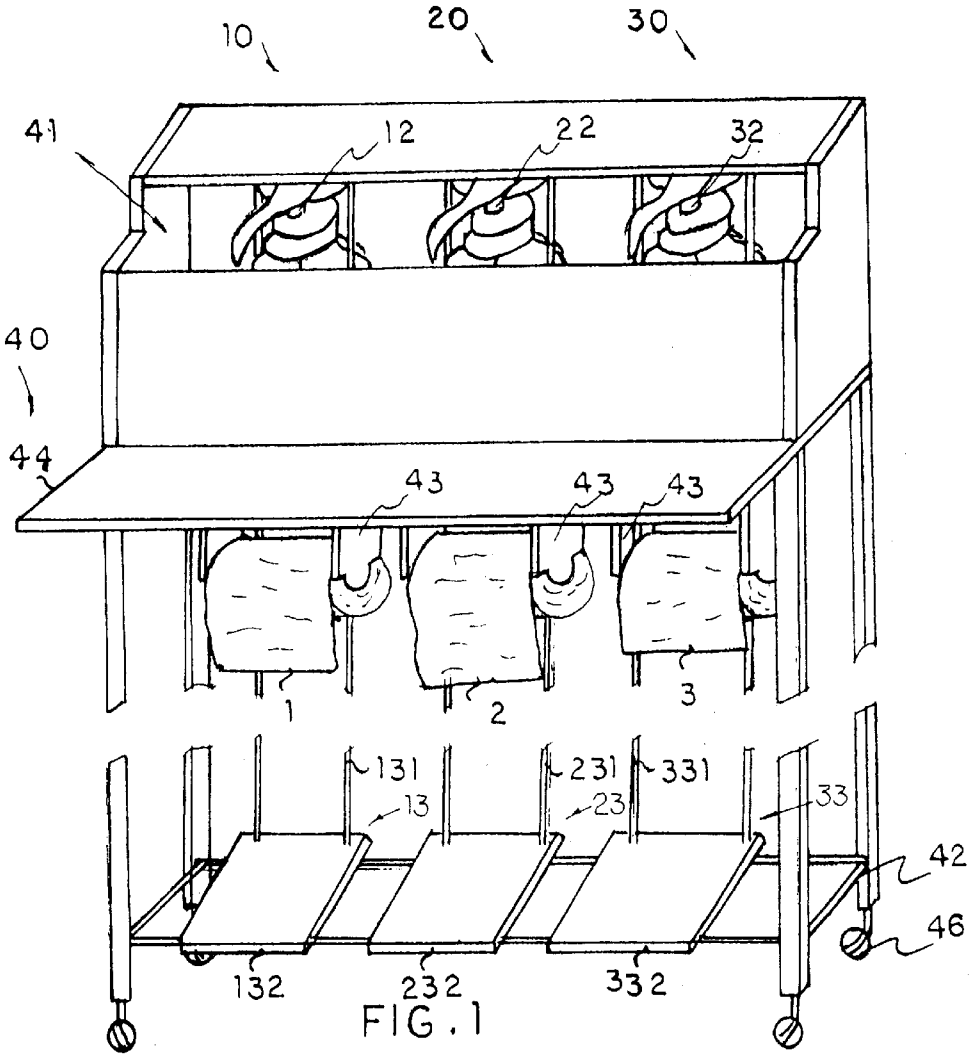
FIG. 1 is a perspective view of a hygiene device according to a preferred embodiment of the present invention.
Figure 4:
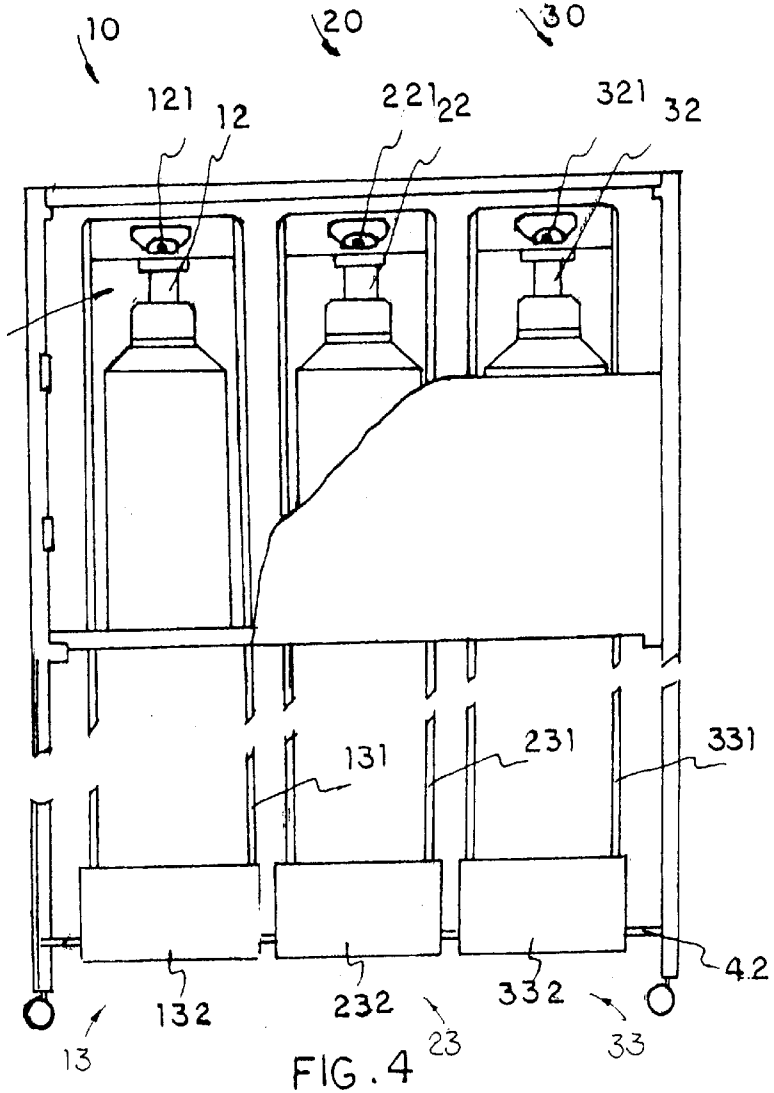
FIG. 4 is a front view of the hygiene device according to the above preferred embodiment of the present invention.

Referring to FIGS. 1 and 4 of the drawings, a hygiene device according to a preferred embodiment of the present invention is illustrated, wherein the hygiene device is adapted for dispensing a predetermined amount of cleansing solution on a wiping medium 1 so as to moisture the wiping medium 1 before it is used. The hygiene device comprises a first cleansing arrangement 10 and a second cleansing arrangement 20.

Figure 3:
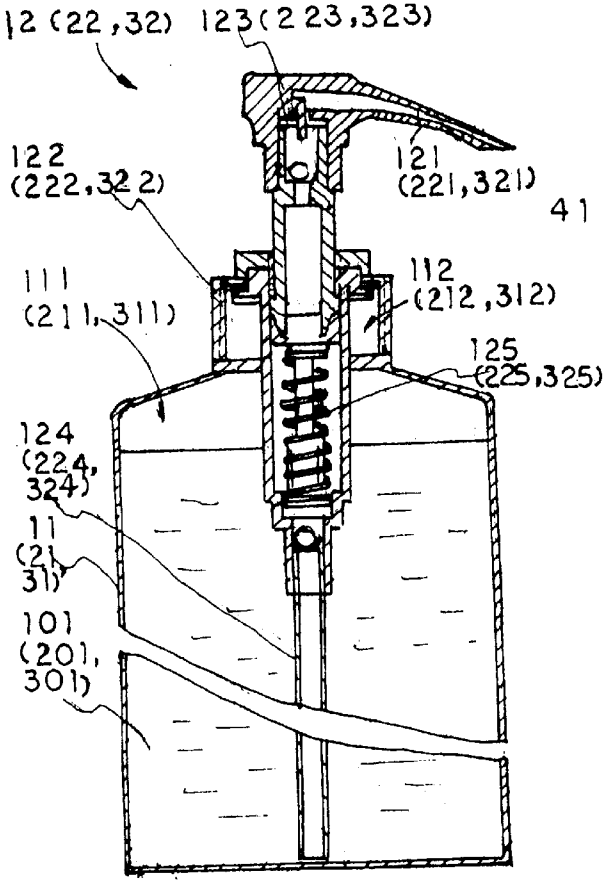
FIG. 3 is a partially sectional view of the hygiene device according to the above preferred embodiment of the present invention.

As shown in FIG. 3, the first cleansing arrangement 10 comprises a first container body 11 having a first liquid reservoir 111 for receiving a first cleansing solution 101 therein and a first opening 112 for communicating the first liquid reservoir 111 with outside, a first pumping unit 12, having a first dispensing nozzle 121, detachably attached to the first container body 11 to sealedly cover the first opening 112 and arranged to pump the first cleansing solution 101 from the first liquid reservoir 111 towards the first dispensing nozzle 121, and a first hands-free actuating unit 13 arranged to actuate the first pumping unit 12 for dispensing a predetermined amount of the first cleansing solution 101 on a first wiping medium 1 via the dispensing nozzle 121.

The second cleansing arrangement 20 comprises a second container body 21 having a second liquid reservoir 211 for receiving a second cleansing solution 201 therein and a second opening 212 for communicating the second liquid reservoir 211 with outside, a second pumping unit 22, having a second dispensing nozzle 221, detachably attached to the second container body 21 to sealedly cover the second opening 212 and arranged to pump the second cleansing solution 201 from the second liquid reservoir 211 towards the second dispensing nozzle 221, and a second hands-free actuating unit 23 arranged to actuate the second pumping unit 22 for dispensing a predetermined amount of the second cleansing solution 201 on a second wiping medium 2 via the second dispensing nozzle 221.

Therefore, the first and second cleansing solutions 101, 201 have different cleaning abilities for selectively moistening the first and second wiping mediums 1, 2 respectively before the first and second wiping mediums 1, 2 are used.

Figure 2:
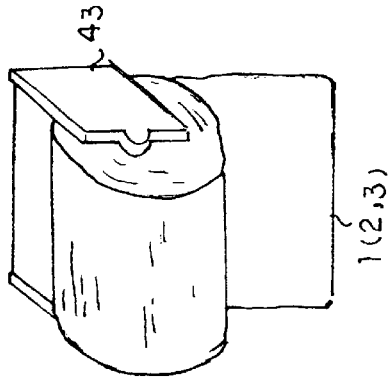
FIG. 2 is a perspective view of a roll of wiping mediums according to the above preferred embodiment of the present invention.

As shown in FIG. 2, each of the first and second wiping mediums 1, 2 is embodied as a regular toilet paper provided in a roll form wherein the toilet paper is commonly used to wipe the user's body, especially after excretion. Accordingly, the first and second wiping mediums 1, 2 can be a paper tower or wiping cloth that is used for other cleaning purpose in a wiping manner.

According to the preferred embodiment, the first cleansing arrangement 10 has the same structure of the second cleansing arrangement 20 wherein the first and second container bodies 11, 21 are embodied to carry the first and second cleansing solutions 101, 102 respectively such that the user is able to select the first and second cleansing solutions 101, 102 to dispense on the first and second wiping mediums 1, 2 respectively.

The first cleansing solution 101 is a detergent that can enhance the cleaning ability of the first wiping medium 1. The second cleansing solution 102 is a disinfectant that makes free bacterial infection on the second wiping medium 2, so as to sterilize the user's body when applying the second wiping medium 2 thereon. Moreover, the first and second solutions 101, 102 can be refilled in the first and second container bodies 11, 21 respectively. It is worth to mention that the first and second cleansing solutions 101, 201 can be selected by the user to fit his or her needs such as using water as a substitution.

As shown in FIG. 3, each of the first and second pumping units, further comprises a cover cap 122, 222 detachably attached on the respective container body 11, 21 to enclose the respective opening 112, 212 thereof, a depressible head unit 123, 223 upwardly extended from the respective cover cap 122, 222 in a vertical movably manner wherein the first and second dispensing nozzles 121, 221 are defined at free ends of the first and second depressible head units 123, 223 respectively, and a pumping pipe 124, 224 extended from the respective depressible head unit 123, 223 to the respective liquid reservoir 111, 211 thereof in such a manner that the depressible head unit 123, 223 is capably of pumping the respective cleansing solution 101, 201 from the liquid reservoir 111, 211 through the pumping pipe 124, 224 when a downward force is applied on the respective depressible head unit 123, 223, so as to dispense the respective cleansing solution 101, 201 to outside via the dispensing nozzle 121, 221 of the depressible head unit 123, 223. Each of the first and second pumping units 12, 22 further a resilient element 125, 225 for applying an urging pressure against the depressible head unit 123, 223 to retain the a depressible head unit 123, 223 in a normal upper position.

Figure 5:
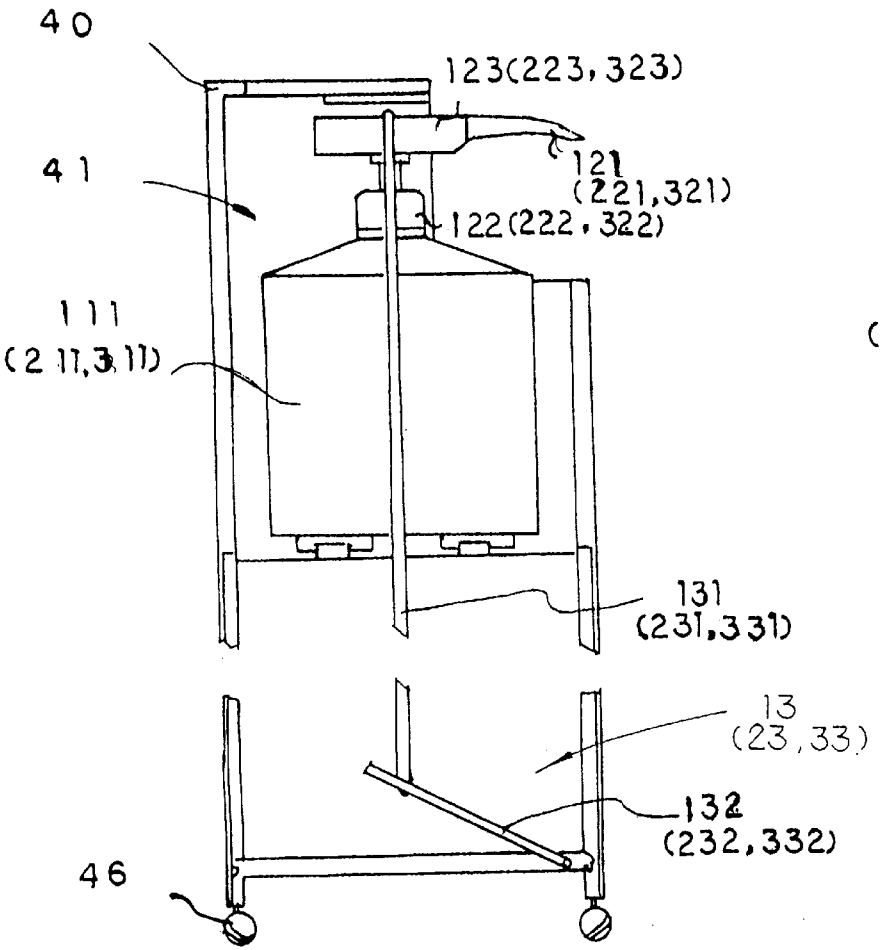
FIG. 5 is a side view of the hygiene device according to the above preferred embodiment of the present invention.

As shown in FIG. 5, each of the first and second hands-free actuating units 13, 23, according to the preferred embodiment, comprises a driving arm 131, 231 having an upper end portion extended on top of the depressible heart unit 123, 223 of the respective pumping unit 12, 22 and a footstep 132, 232 pivotally connected to a lower end of the driving arm 131, 231 and arranged to drive the respective depressible head unit 123, 223 downwardly through the driving arm 131, 231 when a downward force is applied on the footstep 132, 232, so as to dispense the respective cleansing solution 101, 201 via the respective dispensing nozzle 121, 221 of respective container 10, 20.

Each of the first and second driving arms 131, 231 has at least an elastic portion for applying an urging pressure against the respective footstep 132, 232 so as to normally retain and urge the footstep 132, 232 in an upper position.

As shown in FIG. 1, the hygiene device further comprises a third cleansing arrangement 30 comprising a third container body 31 having a third liquid reservoir 311 for receiving a third cleansing solution 301 therein and a third opening 312 for communicating the third liquid reservoir 311 with outside, a third pumping unit 32, having a third dispensing nozzle 321, detachably attached to the third container body 31 to sealedly cover the third opening 312 and arranged to pump the third cleansing solution 301 from the third liquid reservoir 311 towards the third dispensing nozzle 321, and a third hands-free actuating unit 33 arranged to actuate the third pumping unit 32 for dispensing a predetermined amount of the third cleansing solution 301 on a third wiping medium 3 via the dispensing nozzle 321.

Accordingly, the third cleansing solution 301, which is different from the first and second cleansing solutions 101, 201, is a lotion for soothing the user's skin.

The third pumping unit 32, which has the same structure of the first pumping unit 12, further comprises a third cover cap 322 detachably attached on the third container body 31 to enclose the third opening 312 thereof, a third depressible head unit 323 upwardly extended from the third cover cap 322 in a vertical movably manner wherein the third dispensing nozzle 321 is defined at a free end of the third depressible head unit 323, and a third pumping pipe 324 extended from the third depressible head unit 323 to the third liquid reservoir 311 thereof in such a manner that the third depressible head unit 323 is capably of pumping the third cleansing solution 301 from the third liquid reservoir 311 through the third pumping pipe 324 when a downward force is applied on the third depressible head unit 323 50 as to dispense the third cleansing solution 301 to outside via the third dispensing nozzle 321 of the third depressible head unit 323. The third pumping units 32 further a resilient element 325 for applying an urging pressure against the depressible head unit 323 to retain the a depressible head unit 323 in a normal upper position, as shown in FIG. 3.

The third hands-free actuating unit 33 comprises a third driving arm 331 having an upper end portion extended on top of the third depressible head unit 323 of the third pumping unit 32 and a third footstep 332 pivotally connected to a lower end of the third driving arm 331 and arranged to drive the third depressible head unit 323 downwardly through the third driving arm 331 when a downward force is applied on the third footstep 332, so as to dispense the third cleansing solution 301 via the third dispensing nozzle 321 of the third container 30.

As shown in FIGS. 1 and 4, the hygiene device further comprises a supporting frame 40 for securely supporting the first, second, and third cleansing arrangements 10, 20, 30, wherein the supporting frame 40 comprises a container housing 41 for receiving the first, second, and third container bodies 11, 21, 31 side by side respectively and three wiping medium holders 43 to be aligned under the container housing 41 for replaceably holding the first, second, and third wiping mediums 1, 2, 3 respectively, wherein the first, second, and third hands-free actuating units 13, 23, 33 are securely supported by the supporting frame 40 to actuate the corresponding pumping units 12, 22, 32 individually.

Accordingly, the supporting frame 40 further comprises a longitudinal base frame 42 to support the first, second, and third footsteps 132, 232, 332 thereon, such that the user is able to select the one of the cleansing solutions 101, 201, 301 by stepping on the corresponding footstep 132, 232, 332.

The supporting frame 40 further comprises a longitudinal supporting platform 44 transversely supported above the wiping medium holders 43 and aligned with the first, second, and third dispensing nozzles 121, 221, 321. Therefore, the user is able to place the first, second, or third wiping medium 1, 2, 3 on the supporting platform 44 and then actuate the first, second, or third hands-free actuating unit 13, 23, 33 to dispense the respective first, second, or third cleansing solution, 101, 201, 301 on the wiping medium 1, 2, 3. In addition, the supporting frame 46 may further comprise four wheels 46 to facilitate transportation of the hygiene device of the present invention.

Figure 6:
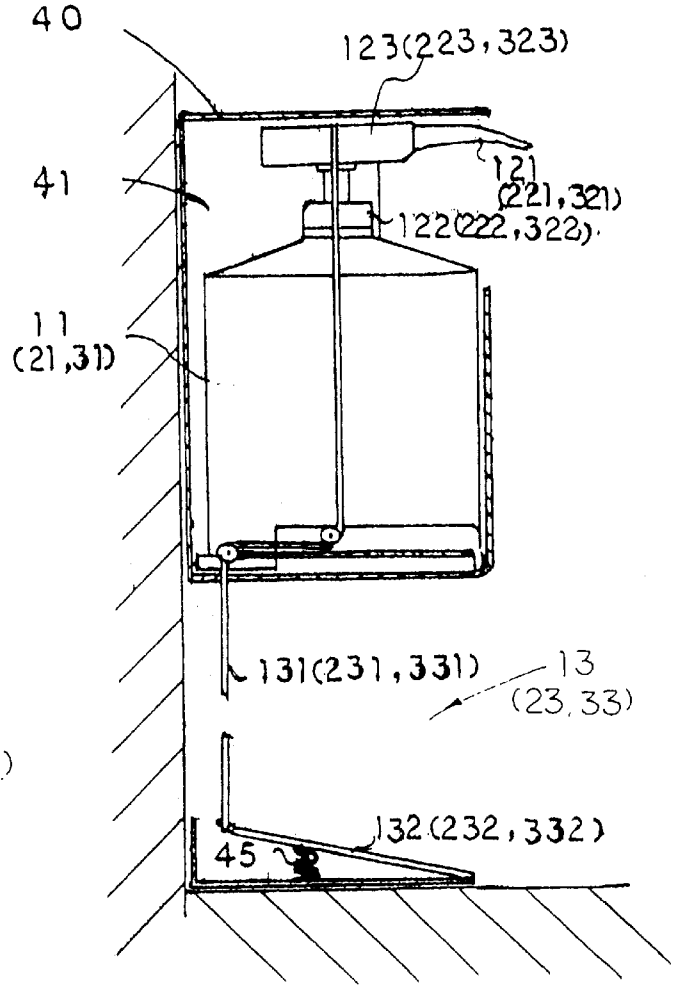
FIG. 6 illustrates a first alternative mode of the hands-free actuating unit of the hygiene device according to the above preferred embodiment of the present invention.

Accordingly, in order to provide the urging pressure against the footstep 132, 232, 332, a resilient member 45 is provided between the base frame 42 and the respective first, second, and third footstep 132, 232, 332 for applying an urging pressure against the respective first, second, and third footstep 132, 232, 332 so as to retain the first, second, and third footsteps 132, 232, 332 in a normal upper position, as shown in FIG. 6.

Figure 7:
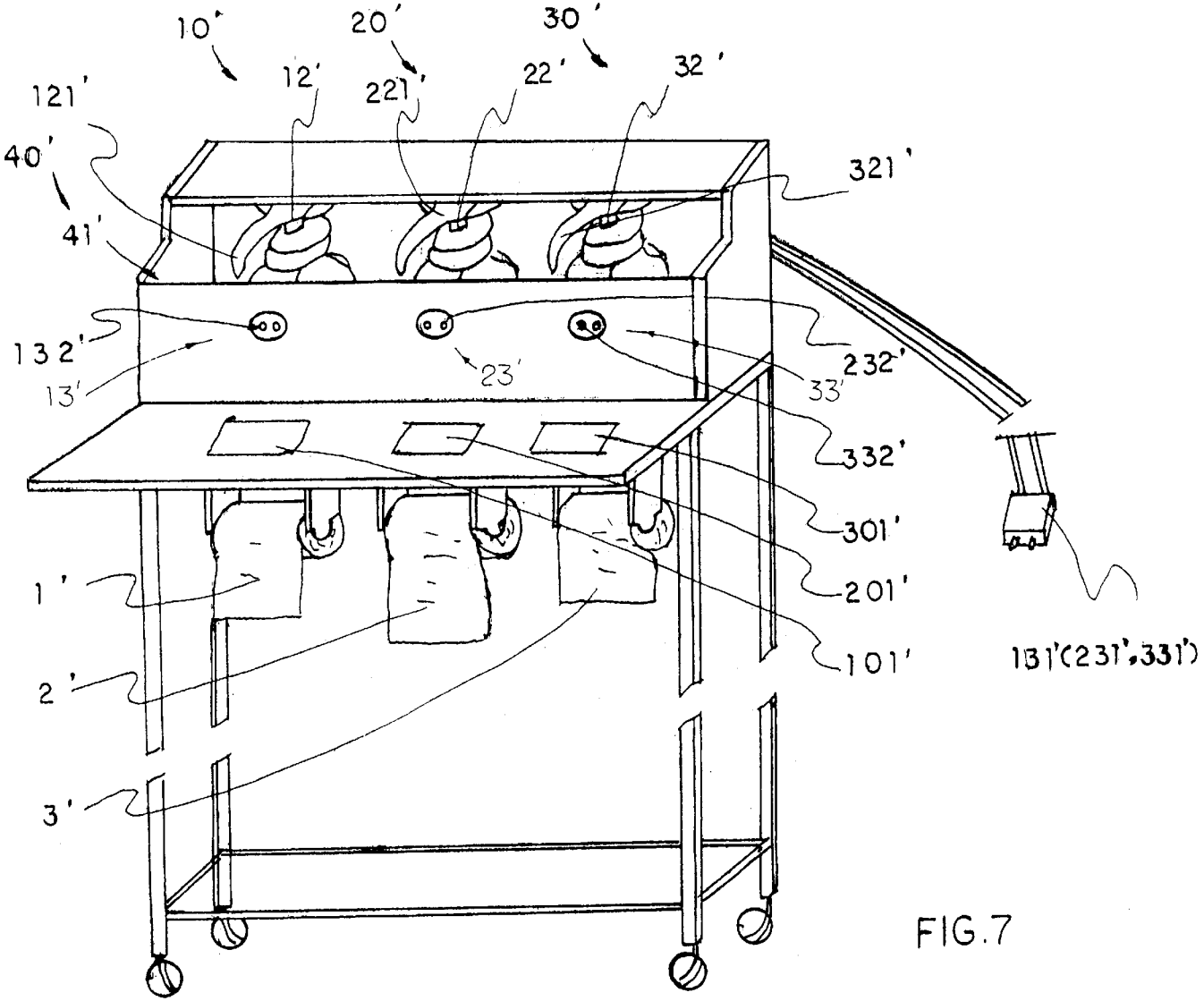
FIG. 7 illustrates a second alternative mode of the hands-free actuating unit of the hygiene device according to the above preferred embodiment of the present invention.

FIG. 7 illustrates an alternative mode of the hands-free actuating unit 13', 23', 33' of the first, second, and third cleansing arrangements 10', 20', 30', wherein each of the first, second, and third hands-free actuating unit 13', 23', 33' comprises a power control device 131', 231', 331' for electrically actuating the respective first, second, and third pumping unit 12', 22', 32' and a photo cell unit 132', 232', 332' for detaching an environmental brightness so that when the photo cell unit 132', 232', 332' detects a change of surrounding brightness, the power control device 1131', 231', 331' is automatically switched on to actuate the respective pumping unit 12', 22', 32', so as to dispense the cleansing solution 101', 201', 301' from the dispensing nozzle 121', 221', 321'.

Accordingly, the photo cell units 132', 232', 332' such as infra-red sensors, are provided on the container housing 41' of the supporting frame 40' and electrically connected with the power control device 131', 231', 331' respectively.

Figure 8:
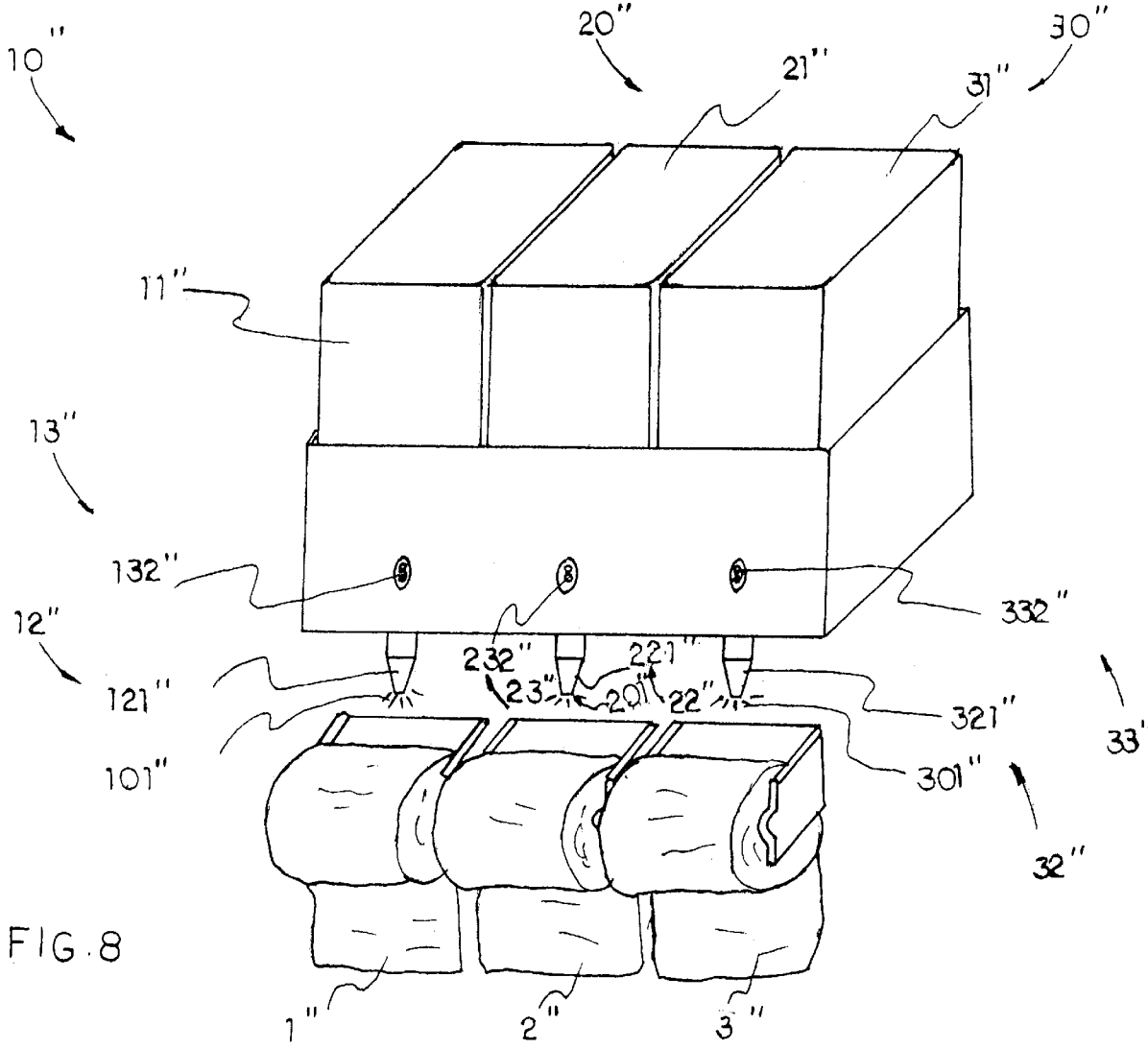
FIG. 8 illustrates an alternative mode of the hygiene device according to the above preferred embodiment of the present invention.

FIG. 8 illustrates an alternative mode of the hygiene device wherein the first, second, and third cleansing arrangements 10", 20", 30" are capable of directly dispensing the first, second, third cleansing solutions 101", 201", 301" on the first, second, and third wiping mediums 1", 2", 3".

The first, second, and third cleansing arrangements 10", 20", 30" are arranged for supporting above the first, second, and third wiping mediums 1", 2", 3" respectively wherein the first, second, and third dispensing nozzles 121", 221", 321" are downwardly extended from the first, second, and third container bodies 11", 21", 31" and aligned with the first, second, and third wiping mediums 1", 2", 3" respectively in such a manner that predetermined amounts of the first, second, and third cleansing solutions 101", 201", 301" are directly dispensed on the first, second, and third wiping mediums 1", 2", 3" respectively before the first, second, and third wiping mediums 1", 2", 3" are used.

Preferably, the first, second, and third hands-free actuating units 13", 23", 33" are embodied with the photo cell units 132", 232", 332" provided on the first, second, and third container bodies 11", 21", 31" respectively, as shown in FIG. 4, and the pumping units 12", 22", 32" are powered by the power control devices 131", 231", 331" respectively.

It is worth to mention that the hygiene device of the present invention and its alternative mode does not require any hand contacting operation in order to moisture the toilet paper of the wiping medium. Therefore, the present invention is well suited for dispensing the cleansing solution for hygiene purpose, so as to prevent the cleansing solution from being polluted by the user's hand.

What is claimed is:

1. A hygiene device, comprising:

a first cleansing arrangement comprising a first container body having a first liquid reservoir for receiving a first cleansing solution therein and a first opening for communicating said first liquid reservoir with outside, a first pumping unit, having a first dispensing nozzle, detachably attached to said first container body to sealedly cover said first opening and arranged to pump said first cleansing solution from said first liquid reservoir towards said first dispensing nozzle, and a first hands-free actuating unit arranged to actuate said first pumping unit for dispensing a predetermined amount of said first cleansing solution on a first wiping medium via said first dispensing nozzle; and a second cleansing arrangement comprising a second container body having a second liquid reservoir for receiving a second cleansing solution therein and a second opening for communicating said second liquid reservoir with outside, a second pumping unit, having a second dispensing nozzle, detachably attached to said second container body to sealedly cover said second opening and arranged to pump said second cleansing solution from said second liquid reservoir towards said second dispensing nozzle, and a second hands-free actuating unit arranged to actuate said second pumping unit for dispensing a predetermined amount of said second cleansing solution on a second wiping medium via said second dispensing nozzle, wherein said first and second cleansing solutions have different cleaning abilities for selectively moistening said first and second wiping mediums respectively before said first and second wiping mediums are used.

2. A hygiene device, as recited in claim 1, wherein said first pumping unit, having a structure identical to said second pumping unit, further comprises a cover cap detachably attached on said first container body to enclose said first opening thereof, a depressible head unit upwardly extended from said first cover cap in a vertical movably manner wherein said first dispensing nozzle is defined at a free end of said first depressible head unit, and a pumping pipe extended from said first depressible head unit to said respective liquid reservoir thereof in such a manner that said depressible head unit is capably of pumping said first cleansing solution from said first liquid reservoir through said pumping pipe when a downward force is applied on said first depressible head unit, so as to dispense said first cleansing solution to outside via said first dispensing nozzle of said depressible head unit.

3. A hygiene device, as recited in claim 2, wherein said first hands-free actuating unit, having a structure identical to said second hands-free actuating unit, comprises a driving arm having an upper end portion extended on top of said depressible head unit of said first pumping unit and a footstep pivotally connected to a lower end of said driving arm and arranged to drive said depressible head unit downwardly through said driving arm when a downward force is applied on said footstep, so as to dispense said first cleansing solution via said first dispensing nozzle of said first container.

4. A hygiene device, as recited in claim 1, wherein said first hands-free actuating unit, having a structure identical to said second hands-free actuating unit, comprises a power control device for electrically actuating said first pumping unit and a photo cell unit for detaching an environmental brightness so as to automatically switch on said power control device to operate said first pumping unit to dispense said first cleansing solution.

5. A hygiene device, as recited in claim 1, wherein said first cleansing solution is a detergent adapted for enhancing a cleaning ability of said first wiping medium and said second cleansing solution is a disinfectant adapted for making free bacterial infection on said second wiping medium.

6. A hygiene device, as recited in claim 3, wherein said first cleansing solution is a detergent adapted for enhancing a cleaning ability of said first wiping medium and said second cleansing solution is a disinfectant adapted for making free bacterial infection on said second wiping medium.

7. A hygiene device, as recited in claim 4, wherein said first cleansing solution is a detergent adapted for enhancing a cleaning ability of said first wiping medium and said second cleansing solution is a disinfectant adapted for making free bacterial infection on said second wiping medium.

8. A hygiene device, as recited in claim 1, further comprising a third cleansing arrangement, having a structure identical to said first cleansing arrangement, comprises a third container body having a third liquid reservoir for receiving a third cleansing solution therein and a third opening for communicating said third liquid reservoir with outside, a third pumping unit, having a third dispensing nozzle, detachably attached to said third container body to sealedly cover said third opening and arranged to pump said third cleansing solution from said third liquid reservoir towards said third dispensing nozzle, and a third hands-free actuating unit arranged to actuate said third pumping unit for dispensing a predetermined amount of said third cleansing solution on a third wiping medium via said dispensing nozzle, wherein said third cleansing solution having a cleaning ability different from said first and second cleansing solutions.

9. A hygiene device, as recited in claim 2, further comprising a third cleansing arrangement, having a structure identical to said first cleansing arrangement, which comprises a third container body having a third liquid reservoir for receiving a third cleansing solution therein and a third opening for communicating said third liquid reservoir with outside, a third pumping unit, having a third dispensing nozzle, detachably attached to said third container body to sealedly cover said third opening and arranged to pump said third cleansing solution from said third liquid reservoir towards said third dispensing nozzle, and a third hands-free actuating unit arranged to actuate said third pumping unit for dispensing a predetermined amount of said third cleansing solution on a third wiping medium via said dispensing nozzle, wherein said third cleansing solution having a cleaning ability different from said first and second cleansing solutions.

10. A hygiene device, as recited in claim 3, further comprising a third cleansing arrangement, having a structure identical to said first cleansing arrangement, which comprises a third container body having a third liquid reservoir for receiving a third cleansing solution therein and a third opening for communicating said third liquid reservoir with outside, a third pumping unit, having a third dispensing nozzle, detachably attached to said third container body to sealedly cover said third opening and arranged to pump said third cleansing solution from said third liquid reservoir towards said third dispensing nozzle, and a third hands-free actuating unit arranged to actuate said third pumping unit for dispensing a predetermined amount of said third cleansing solution on a third wiping medium via said dispensing nozzle, wherein said third cleansing solution having a cleaning ability different from said first and second cleansing solutions.

11. A hygiene device, as recited in claim 4, further comprising a third cleansing arrangement, having a structure identical to said first cleansing arrangement, comprises a third container body having a third liquid reservoir for receiving a third cleansing solution therein and a third opening for communicating said third liquid reservoir with outside, a third pumping unit, having a third dispensing nozzle, detachably attached to said third container body to sealedly cover said third opening and arranged to pump said third cleansing solution from said third liquid reservoir towards said third dispensing nozzle, and a third hands-free actuating unit arranged to actuate said third pumping unit for dispensing a predetermined amount of said third cleansing solution on a third wiping medium via said dispensing nozzle, wherein said third cleansing solution having a cleaning ability different from said first and second cleansing solutions.

12. A hygiene device, as recited in claim 8, wherein said first cleansing solution is a disinfectant adapted for making free bacterial infection on said first wiping medium, said second cleansing solution is a detergent adapted for enhancing a cleaning ability of said second wiping medium, and said third cleansing solution is a lotion adapted for soothing a user's skin.

13. A hygiene device, as recited in claim 10, wherein said first cleansing solution is a detergent adapted for enhancing a cleaning ability of said first wiping medium, said second cleansing solution is a disinfectant adapted for making free bacterial infection on said second wiping medium, and said third cleansing solution is a lotion adapted for soothing a user's skin.

14. A hygiene device, as recited in claim 11, wherein said first cleansing solution is a detergent adapted for enhancing a cleaning ability of said first wiping medium, said second cleansing solution is a disinfectant adapted for making free bacterial infection on said second wiping medium, and said third cleansing solution is a lotion adapted for soothing a user's skin.

15. A hygiene device, as recited in claim 10, wherein said first cleansing solution is a disinfectant adapted for making free bacterial infection on said first wiping medium, said second cleansing solution is a detergent adapted for enhancing a cleaning ability of said second wiping medium, and said third cleansing solution is a lotion adapted for soothing a user's skin.

16. A hygiene device, as recited in claim 11, wherein said first cleansing solution is a disinfectant adapted for making free bacterial infection on said first wiping medium, said second cleansing solution is a detergent adapted for enhancing a cleaning ability of said second wiping medium, and said third cleansing solution is a lotion adapted for soothing a user's skin.

17. A hygiene device, as recited in claim 10, further comprising a supporting frame for securely supporting said first, second, and third cleansing arrangements wherein said supporting frame comprises a container housing for receiving said first, second, and third container bodies side by side respectively and three wiping medium holders to be aligned under said container housing for replaceably holding said first, second, and third wiping mediums respectively, wherein said first, second, and third hands-free actuating units are securely supported by said supporting frame to actuate said corresponding pumping units individually.

18. A hygiene device, as recited in claim 11, further comprising a supporting frame for securely supporting said first, second, and third cleansing arrangements wherein said supporting frame comprises a container housing for receiving said first, second, and third container bodies side by side respectively and three wiping medium holders to be aligned under said container housing for replaceably holding said first, second, and third wiping mediums respectively, wherein said first, second, and third hands-free actuating units are securely supported by said supporting frame to actuate said corresponding pumping units individually.

19. A hygiene device, as recited in claim 17, wherein said supporting frame further comprises a longitudinal supporting platform, which is adapted for placing said first, second, and third wiping mediums thereon, transversely supported above said wiping medium holders and aligned with said first, second, and third dispensing nozzles.

20. A hygiene device, as recited in claim 18, wherein said supporting frame further comprises a longitudinal supporting platform, which is adapted for placing said first, second, and third wiping mediums thereon, transversely supported above said wiping medium holders and aligned with said first, second, and third dispensing nozzles.

21. A hygiene device, as recited in claim 8, wherein said first, second, and third cleansing arrangements are arranged for supporting above said first, second, and third wiping mediums respectively, and wherein said first, second, and third dispensing nozzles are downwardly extended from said first, second, and third container body and aligned with said first, second, and third wiping mediums respectively in such a manner that predetermined amounts of said first, second, and third cleansing solutions are directly dispensed on said first, second, and third wiping mediums respectively before said first, second, and third wiping mediums are used.

22. A hygiene device, as recited in claim 12, wherein said first, second, and third cleansing arrangements are arranged for supporting above said first, second, and third wiping mediums respectively, and wherein said first, second, and third dispensing nozzles are downwardly extended from said first, second, and third container body and aligned with said first, second, and third wiping mediums respectively in such a manner that predetermined amounts of said first, second, and third cleansing solutions are directly dispensed on said first, second, and third wiping mediums respectively before said first, second, and third wiping mediums are used.

* * * * *